US005603644A

United States Patent [19]

Kobayashi et al.

[11] Patent Number: 5,603,644

[45] Date of Patent: Feb. 18, 1997

[54] JET PROPULSION BOAT

[75] Inventors: Noboru Kobayashi; Yoshiki Futaki, both of Iwata, Japan

[73] Assignee: Yamaha Hatsudoki Kabushiki Kaisha, Iwata, Japan

[21] Appl. No.: 775,740

[22] Filed: Oct. 11, 1991

[30] Foreign Application Priority Data

| | | | |
|---|---|---|---|
| Oct. 12, 1990 | [JP] | Japan | 2-274016 |
| Oct. 12, 1990 | [JP] | Japan | 2-274017 |
| Oct. 19, 1990 | [JP] | Japan | 2-283027 |

[51] Int. Cl.[6] ..... B60K 41/00

[52] U.S. Cl. ..... 440/86

[58] Field of Search ..... 440/40, 41, 38, 440/84, 86, 87, 2; 362/83.3, 276, 802, 257; 114/177, 178; 441/68; 116/19, 21, 26, 36, 35 R, 37, 38, DIG. 43

[56] References Cited

U.S. PATENT DOCUMENTS

| | | | |
|---|---|---|---|
| 1,947,332 | 2/1934 | Christen | 440/2 |
| 2,201,987 | 5/1940 | Conover | 440/900 |
| 2,412,825 | 12/1946 | McCollum | 440/900 |
| 2,580,367 | 12/1951 | Stevens . | |
| 3,135,234 | 6/1964 | Turnidge . | |
| 3,185,124 | 5/1965 | Spence . | |
| 3,380,022 | 4/1968 | Raschke | 116/36 |
| 3,613,632 | 10/1971 | Farrell | 440/2 |
| 3,797,447 | 3/1974 | Stubblefield . | |
| 3,918,256 | 11/1975 | Ashleman | 440/84 |
| 4,176,616 | 12/1979 | Robins . | |
| 4,200,055 | 4/1980 | Siegel | 440/84 |
| 4,228,760 | 10/1980 | Kulischenko | 440/86 |
| 4,362,516 | 12/1982 | Lyons | 440/86 |
| 4,801,282 | 1/1989 | Ogawa | 440/86 |
| 4,813,895 | 3/1989 | Takahashi | 440/41 |
| 4,856,452 | 8/1989 | Pingel | 114/364 |
| 5,012,757 | 5/1991 | Williams | 116/19 |
| 5,052,327 | 10/1991 | Comfort | 116/26 |
| 5,062,815 | 11/1991 | Kobayashi | 440/86 |

FOREIGN PATENT DOCUMENTS

| | | | |
|---|---|---|---|
| 57-7793 | 1/1982 | Japan | 440/2 |

*Primary Examiner*—Lee W. Young
*Assistant Examiner*—C. T. Bartz
*Attorney, Agent, or Firm*—Knobbe, Martens, Olson & Bear, LLP

[57] ABSTRACT

A number of embodiments of jet propelled watercrafts having reverse thrust mechanisms and wherein an indicator is provided for indicating to following watercraft when the watercraft is being rapidly braked or rapidly turned. The watercraft has adjacent throttle and shift lever controls and various control lever positions are disclosed for facilitating ease of operation and compact construction.

31 Claims, 15 Drawing Sheets

JET PROPULSION BOAT

BACKGROUND OF THE INVENTION

This invention relates to a jet propulsion boat and more particularly to an improved device for braking or reversing such a boat, indicating that the boat is operating in a rapid slow down mode, and a control mechanism for the transmission and throttle of such a boat.

As is well known, watercraft normally do not have a braking system of the type found on land vehicles. Therefore, in order to slow a watercraft, it is a normal practice to shift the transmission of the propulsion device into a reverse drive so as to rapidly slow the watercraft. For example, if the watercraft is propelled by a jet propulsion unit, there are provided reverse thrust buckets for reversing the thrust of the jet propulsion unit so as to accomplish rapidly braking.

There are many times, however, where watercraft may be operating in closely confined spaces and one watercraft may be following another closely. If the leading watercraft shifts into a braking mode without warning the following watercraft, obvious problems can arise.

It is, therefore, a principal object of this invention to provide a warning system for indicating when a watercraft is being braked rapidly.

Most watercraft transmission controls comprise a single lever that is pivotable between a forward drive position, a neutral position and a reverse drive position. Conventionally, such shift controls move in a straight line between these three positions. Because of this straight line motion, there is always the possibility that a operator may inadvertently move the transmission from a forward drive mode to a reverse drive mode when he does not intend to. Furthermore, even if the movement is not accidental, there may be some instance when it is desirable to insure that the operator must pause for a minute in neutral before shifting into reverse so as to give the other occupants of the watercraft an opportunity to brace themselves against the sudden braking force.

It is, therefore, a still further object of this invention to provide an improved transmission control for a watercraft in which the operator must consciously effect movement from forward to reverse with a slight pause.

Many forms of watercraft embody separate transmission and throttle controls. There are times, however, when it is desirable that the operator can operate both controls with the same hand. Also, it is also desirable, at times, to prevent inadvertent operation of the wrong control by the hand of the operator.

It is, therefore, a still further object of this invention to provide an improved throttle and transmission control for a watercraft wherein the controls are easily accessible by the operator, can both be operated by the same hand under certain circumstances but which can not be inadvertently mis-operated.

SUMMARY OF THE INVENTION

A first feature of the invention is adapted to be embodied in a marine vessel comprised of a hull and means carried by the hull for propelling the hull and for braking the forward speed of the hull. In accordance with this feature of the invention, indicator means are provided for providing an indication when the speed of the hull is being braked.

Another feature of the invention is adapted to be embodied in a control for a vessel that is comprised of a hull and means carried by the hull for propelling the hull and for braking the forward speed of the hull. Control means are operatively connected to the means for propelling and braking for operating that means. This control means comprises a single operator moveable between a forward drive position and a braking position and interlock means for preventing direct uninterrupted movement of the single operator from its forward drive position to its braking position.

Other features of the invention are adapted to be embodied in a throttle and transmission control for a watercraft comprising a first transmission control lever supported for motion between forward, neutral and reverse positions. A second, throttle control lever is supported for movement between idle, full speed and intermediate positions.

In accordance with a first feature of the invention embodied in such a control, means are provided for mounting the levers for movement in parallel directions one behind the other.

In accordance with a second feature of a control in accordance with the invention, the levers are mounted for movement in parallel directions in close proximity to each other but leaving a space between the levers when each of them are in extreme, adjacent positions.

In accordance with a third feature of a control embodying the invention, the levers are mounted for movement in parallel directions and are disposed so that their operating portions will be at approximately the same height when they are adjacent to each other.

In accordance with a forth feature of the invention embodied in such a control, the levers are mounted in such a way that there will be a difference in height in their control portions when adjacent to each other so that an operator can readily discriminate between them and can operate a selected lever without interference.

DETAILED DESCRIPTION OF THE PREFERRED EMBODIMENTS OF THE INVENTION

Figure 1:
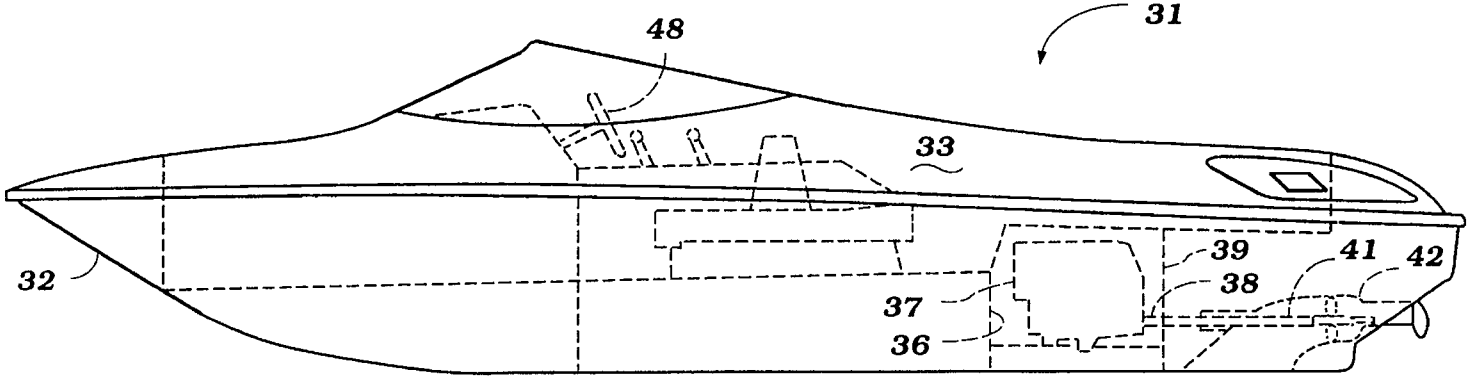
FIG. 1 is a side elevational view of a watercraft constructed in accordance with an embodiment of the invention.
Figure 2:
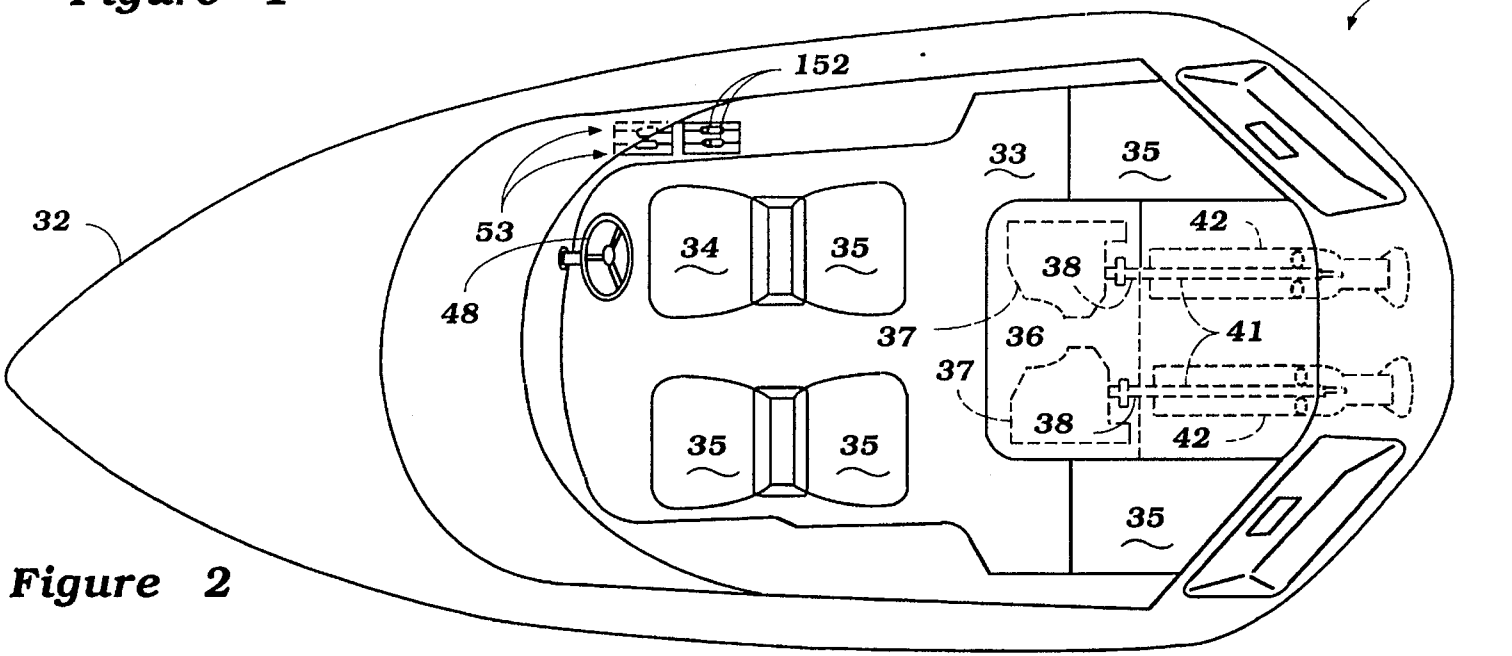
FIG. 2 is a top plan view thereof.
Figure 3:
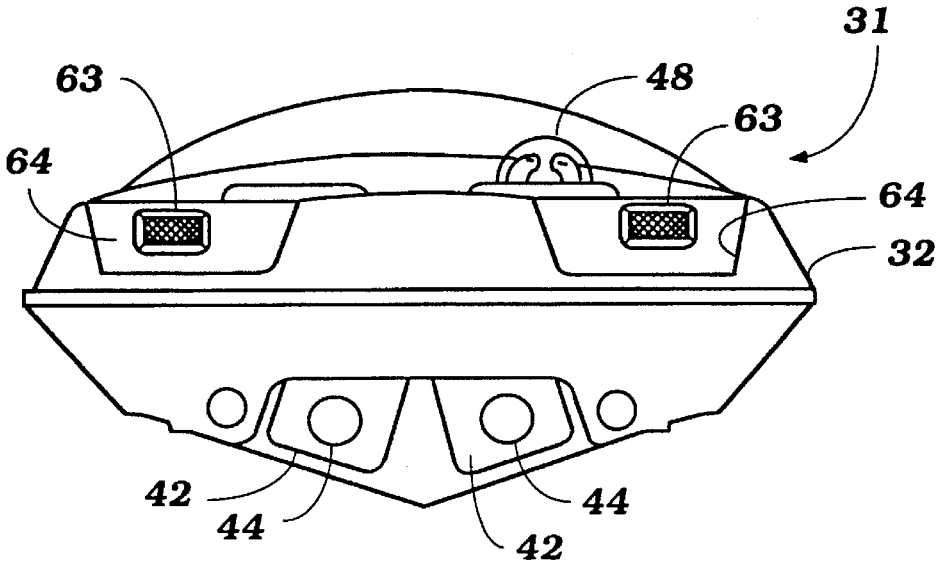
FIG. 3 is a rear elevational view thereof.

Referring to FIGS. 1 through 3, a watercraft constructed in accordance with a first embodiment of the invention is identified generally by the reference numeral 31. In addition, these figures may be considered to be typical of all embodiments, except for the throttle and transmission controls, as will become apparent as this description proceeds.

The watercraft 31 is comprised of a hull assembly 32 which may be formed from a suitable material such as a molded fiberglass reinforced resinous plastic material. The hull 32 defines a rider's area 33 in which a driver's seat 34 and a plurality of passenger seats 35 may be provided. The seating arrangement shown in the figures is only a typical one which may be employed in conjunction with the invention, as should be readily apparent to those skilled in the art.

To the rear of the rider's compartment 33 there is provided an engine compartment 36 in which a pair of internal combustion engines of any known type, indicated by the reference numeral 37, are positioned. Although the invention is described in conjunction with an arrangement employing two engines, it is to be understood that the invention may also be practiced with watercraft powered by only one engine. Also, although the invention is described in conjunction with an inboard engine and propulsion unit, it should be readily apparent that the invention or at least certain facets of it are susceptible of use with inboard outboard drives or with outboard motors.

The engines 37 have their respective drive shafts 38 extending through a bulkhead 39 and coupled to the impeller shafts 41 of jet propulsion units 42. Again, although a twin jet propelled watercraft is depicted, it is to be understood that the invention can be employed with watercraft powered by a single jet propulsion unit or, for that matter, by watercraft that are other than jet propelled. However, the invention has particular utility in conjunction with jet propelled watercraft.

Each jet propulsion unit 42 is provided with a discharge nozzle portion 43 (FIGS. 5 and 6) that registers with a steering nozzle 44 that is supported for steering movement about a vertically extending steering axis by pivot pins 45, only one of which appears in the drawings. A steering lever 46 extends outwardly from one side of the steering nozzle 44 and is connected by means of a bowden wire cable 47 to a steering wheel 48 (FIGS. 1 through 3) mounted within the passenger compartment 33 forwardly of the operator's seat 34.

The steering nozzles of the two jet propulsion units 42 are connected to each other in a suitable manner so that they will both be steered by the steering wheel 48. Since this mechanism forms no part of the invention, it has not been illustrated.

Figure 15:
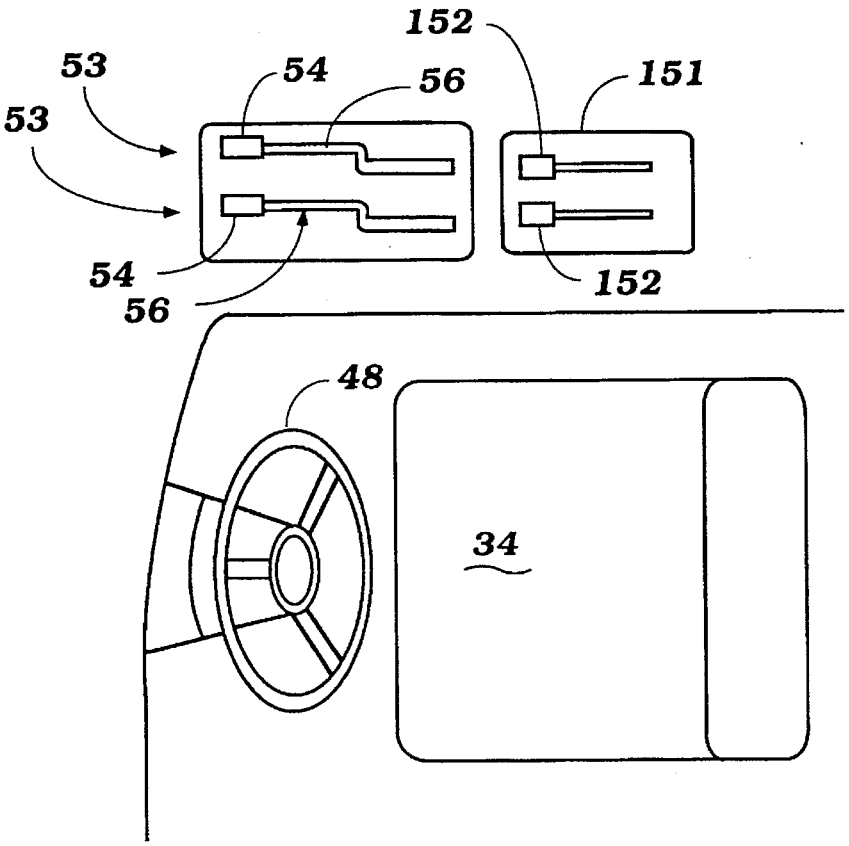
FIG. 15 is an enlarged top plan view showing the relationship of the various controls to the operator's seat.

A reverse thrust bucket 49 is pivotally mounted on each steering nozzle 44 for movement about a generally horizontally extending axis by means of a pair of spaced apart pivot pins 51, only one of which appears in the drawings. A bowden wire cable 52 is connected to the reverse thrust bucket 49 at its rear end and at its forward end is connected to a respective shift control, indicated generally by the reference numeral 53 and having a construction of the type which will be described. Basically, the shift control 53 includes a shift control lever 54 mounted within a housing assembly 55 for pivotal movement about a pivot shaft 56. The shift control lever 54 is movable between a forward position as indicated by the solid line view in FIG. 5 and neutral and reverse positions as so indicated in this figures and shown in phantom. Since the watercraft 31 is propelled by two jet propulsion units there are two transmission controls 53 each positioned at one side of the rider's seat 34 in side by side fashion as best shown in FIGS. 2 and 15.

As is conventional, the shift control housing 55 is provided with a slot, indicated generally by the reference numeral 56 (FIGS. 5 and 7) through which the lever 54 moves during its shifting motion. However, conventional slots for shift control levers are straight and uninterrupted and permit the operator to freely and uninhibitly move the shift control lever 54 between its various positions. It should be noted that frequently the shift control lever 54 is moved to a reverse position even when the watercraft is operating forwardly to affect rapid braking. In addition, when two jet propulsion units are employed, as in the illustrated embodiment, one may be shifted into reverse to permit more sharp turning when the watercraft is being maneuvered. However, such rapid movement to the braking position can sometimes occur accidentally and also may catch the occupants unaware.

In accordance with a feature of the invention, the shift control 53 for each jet propulsion unit is provided with an interlock type of mechanism so as to preclude movement to a braking position without conscious effort on the part of the operator. Said another way, the operator must intend to move the shift control lever 54 to its braking position before such position can be reached. The way in which this is done will now be described by particular reference to FIGS. 5 through 11.

The slot 56 is formed with a first portion 57 which is generally straight and which permits the movement of the shift control lever 54 from its forward position as shown by the line 8 to its neutral position as shown by the line 9 and then to a partial reverse or braking position as shown by the line 10 where a gate 58 is formed. This particular gate construction is only one form in which the invention may take and the gate 58 may actually be positioned at the neutral position. However, in the illustrated embodiment the gate 58 is provided at the point where a significant braking force will be encountered so that some braking possible although maximum braking can not be accomplished. The respective position of the reverse thrust bucket 49 in each of the positions 8, 9 and 10 appears in these figures.

Figure 11:
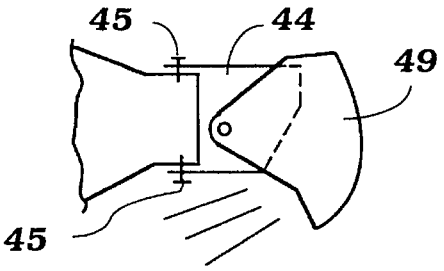
FIG. 11 is a side elevational view showing the position of the reverse thrust bucket when the shift lever is in the position shown by the . - line indicated by the reference numeral 11 in FIG. 7.

In order to move to the full braking position shown in FIG. 11 and by the line 11, the operator must move the shift lever 54 transversely through the gate portion 58 before movement can the occur along a straight portion 59 to the full reverse braking position. Thus, the operator must consciously move the shift lever 54 transversely rather than in a straight line and then rearwardly so as to accommodate full braking operation. As noted above, the gate 58 may be positioned at another position such as the neutral position.

The transverse movement of the shift lever 54 is accommodated either by providing a universal joint in the connection to the pivot pin 56 or by mounting the lever 54 on the pivot pin 56 so that it may slide sideways as well as pivot.

As has been noted, when the reverse thrust bucket 49 is moved into its full reverse position, substantial braking forces will be generated. These forces can even be increased by speeding up the driving engine 37. Also, as has been noted, one of the reverse thrust buckets 49 may be moved to its full braking position to accommodate a more rapid turn. Although this has advantages, it can cause difficulties when another watercraft is following close behind. In accordance with another feature of the invention, a warning system is provided for warning following watercraft if either of the aforenoted conditions occur.

Figure 4:
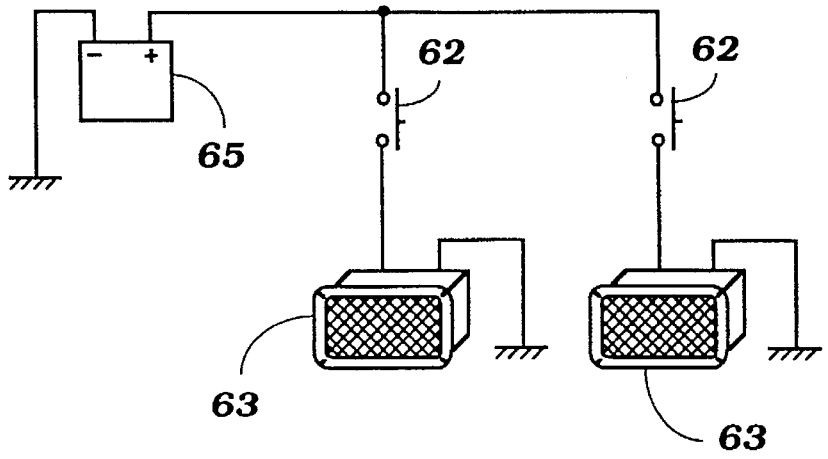
FIG. 4 is a partially schematic electrical diagram showing the brake warning system.
Figure 12:
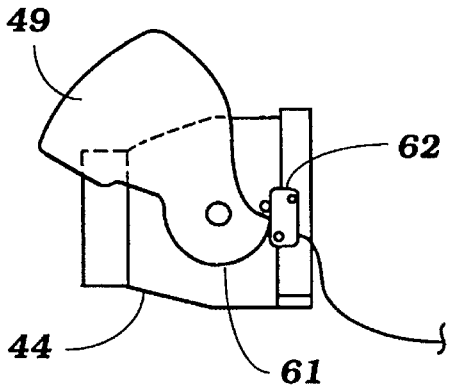
FIG. 12 is a side elevational view showing the reverse sensor and the relationship when the reverse thrust bucket is in the forward drive position.
Figure 13:
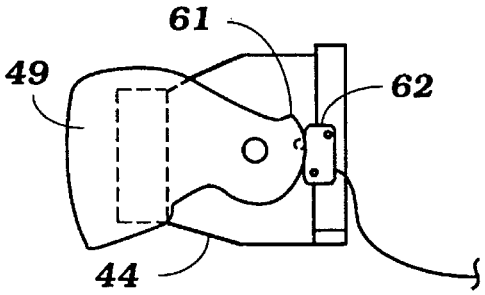
FIG. 13 is a side elevational view, in part similar to FIG. 12, and shows the condition when the reverse thrust bucket is in its reverse position.

FIGS. 12 and 13 show one part of the warning system wherein one side of the reverse thrust bucket 49 is provided with an operating cam 61 which is adapted to engage a limit switch 62 mounted at this same side on the steering nozzle 44 when the reverse thrust bucket 49 is in its full reverse maximum braking position. As may be seen in FIG. 4, the switches 62 are each in circuit with respective warning lights 63 mounted in recesses 64 on the transom of the hull 32 (FIG. 3) so as to be readily viewed by following watercraft. A battery 65 completes the circuit. Hence, when both reverse thrust buckets 49 are moved to their full braking position both lights 63 will be illuminated and a following watercraft will be warned of sudden braking. Alternatively, if only one light goes on, the following watercraft will be warned that a sudden turn is going to be made. In addition to the transom mounted warning light 63, indicator lights (not shown) may be mounted on the dash panel adjacent the steering wheel 48 so as to permit the operator or occupants of the watercraft to also know that full braking force is being exerted.

Figure 14:
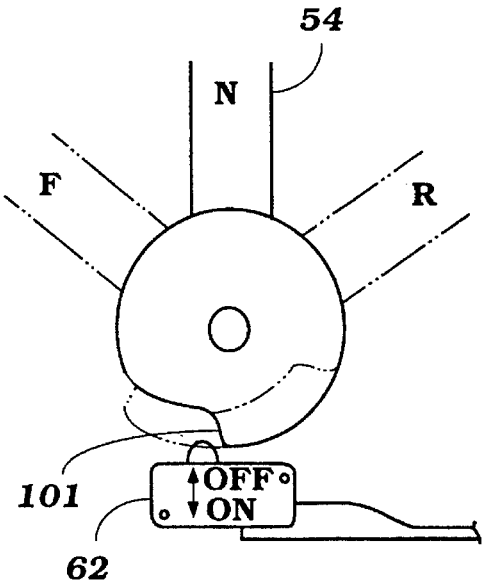
FIG. 14 is a side elevational partial view showing another location for the braking sensor.

In the embodiment as described, the switches 62 for sensing reverse braking condition where mounted on the steering nozzles 44. There are some advantages in mounting the switches to sense reverse condition out of the body of water in which the watercraft is operating and FIG. 14 shows one way in which this may be done. In this embodiment, a cam lobe 101 is formed on the lower portion of the shift lever 54 and contacts the limit switch 62 for actuating it when the shift lever 54 is moved to its full reverse condition. As with the previously described embodiments, the shift lever 54 may actuate the switch 62 when the bucket 49 has been moved out of its neutral position toward the full reverse position. Also, the limit switch 62 may be positioned so as to actuated by the transverse movement of the switch lever 54 necessary to go through the gate 58 to enter the reverse slot 59.

Figure 5:
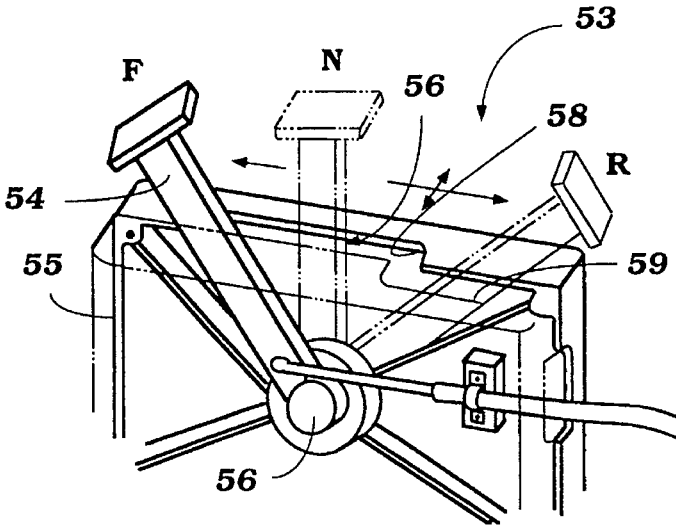
FIG. 5 is a perspective view, with portions broken away showing the transmission and control in the forward drive position.
Figure 6:
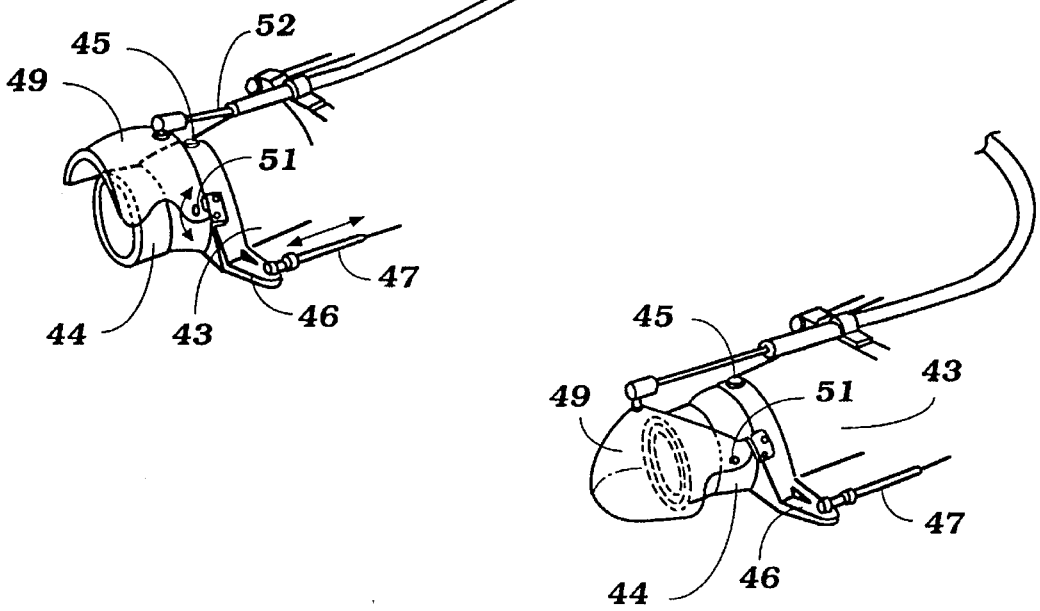
FIG. 6 is a partial perspective view showing the transmission control in a reverse drive mode.
Figure 7:
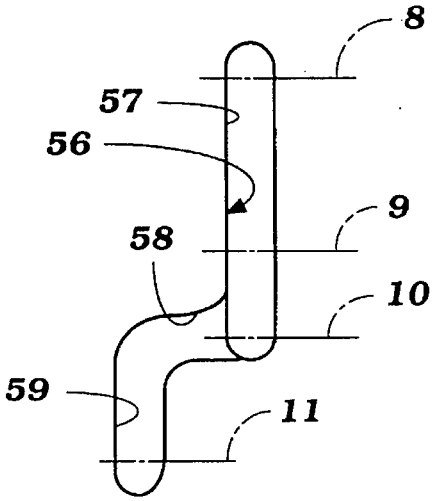
FIG. 7 is a view showing the shift gate.
Figure 8:
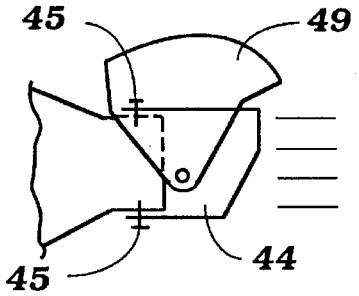
FIG. 8 is a view showing the position of the reverse thrust bucket when the shift lever is in the position shown by the . - line 8 in FIG. 7.
Figure 9:
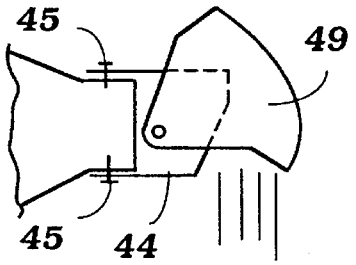
FIG. 9 is a side elevational view showing the position of the reverse thrust bucket when the shift lever is in the position shown in the . - line indicated by the reference numeral 9 in FIG. 7.
Figure 10:
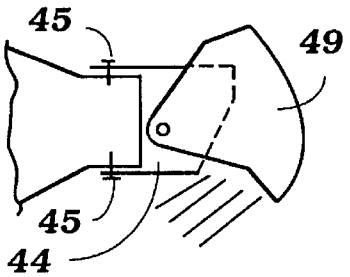
FIG. 10 is a side elevational view showing the position of the reverse thrust bucket when the shift lever is in the position shown by the . - line indicated by the reference numeral 10 in FIG. 7.
Figure 16:
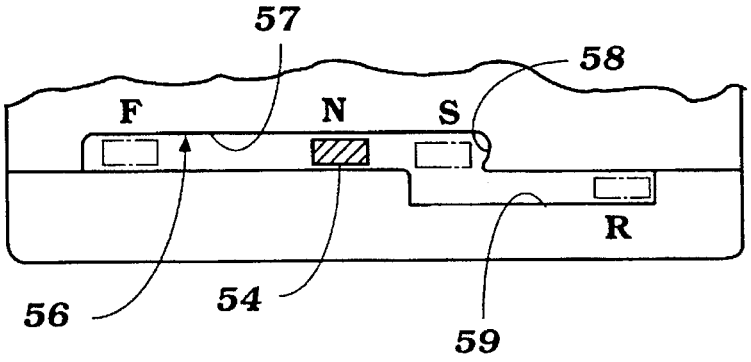
FIG. 16 is a top plan view, in part similar to FIG. 7, and shows the various positions of the shift lever in another embodiment.

FIG. 16 shows a slot arrangement that is slightly different from that of FIGS. 5 and 7 in that the gate portion 58 actually has a notched area into which the switch lever 54 may be moved and locked if the operator attempts to pull the lever full back into reverse. Therefore, with this embodiment the operator will have to move the shift lever 54 slightly forwardly again to go into the reverse portion 59 of the slot 56. Various other types of interlock arrangements may be employed.

Figure 17:
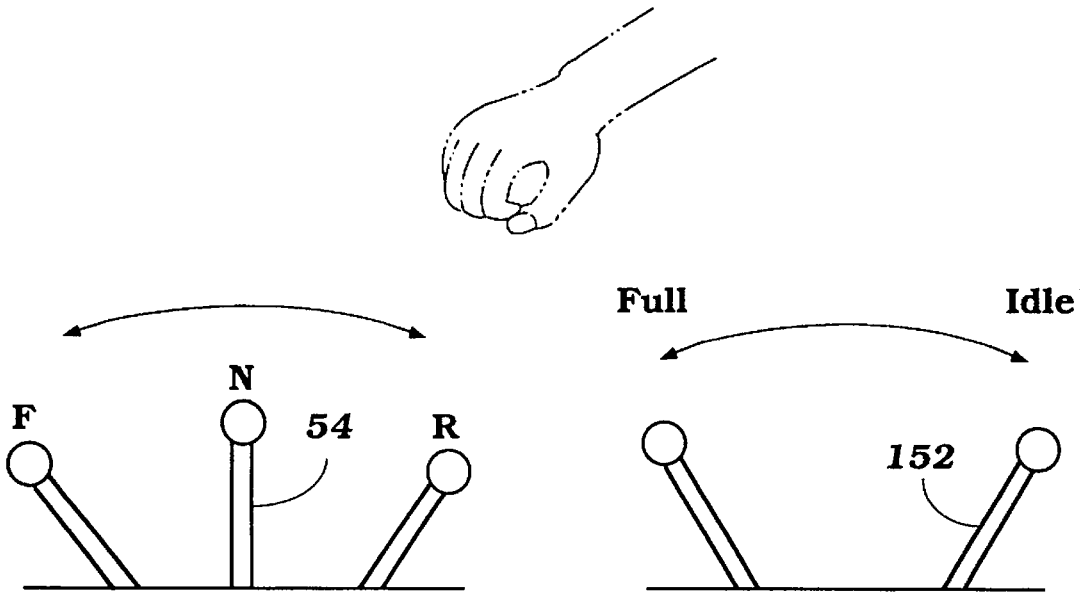
FIG. 17 is an enlarged side elevational view showing the relationship of the transmission and throttle controls to an operator's hand.

In addition to the transmission controls 53, the watercraft is also provided with throttle controls for each of the engines 37. One embodiment of positioning these throttle controls is best shown in FIGS. 2, 15 and 17 and in this embodiment the throttle control mechanism, indicated generally by the reference numeral 151 is positioned immediately to the rear of the paired transmission controls 53. The throttle control 151 includes a pair of throttle control levers 152 which are pivotally supported and moved generally in planes parallel to those of the shift control levers 54. These throttle control levers 152 are connected in any suitable manner, such as bowden wire cables, to the throttles of the engines 37.

In accordance with this embodiment of the invention, the throttle control levers 152 are positioned immediately to the rear of the respective transmission control levers 54 but there is a slight spacing so that an operator may place his hand between the levers when the shift levers 54 are in their reverse positions and the throttle levers 152 are in their full throttle positions. The positioning is such, however, so that an operator can operate both throttle control lever 152 and shift control lever 54 with the same hand. This is important because frequently the operator will want to move the throttle control lever 152 to the full throttle position so as to accomplish full and rapid braking.

Figure 18:
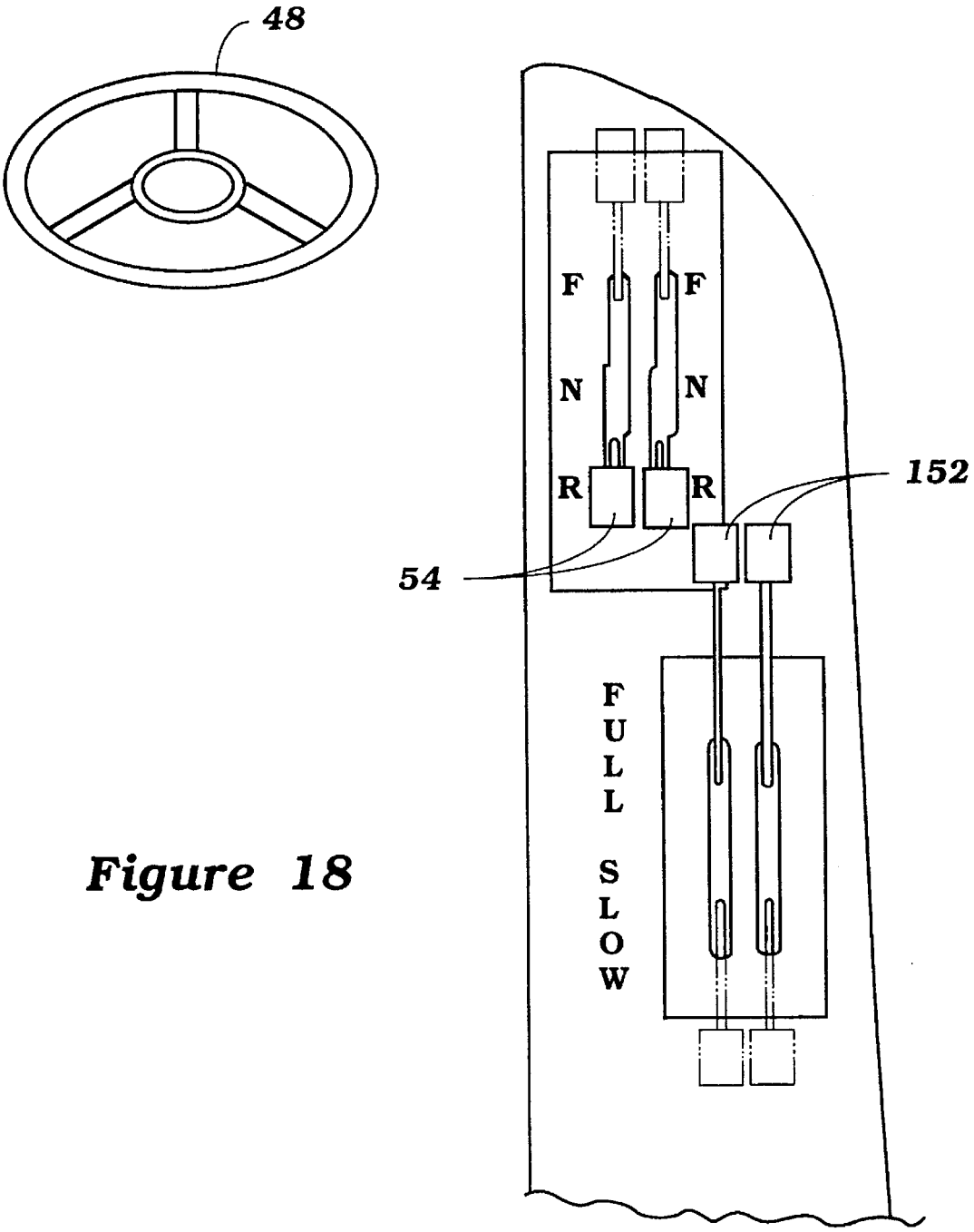
FIG. 18 is a top plan view, in part similar to FIG. 15, and shows another embodiment of the invention.
Figure 19:
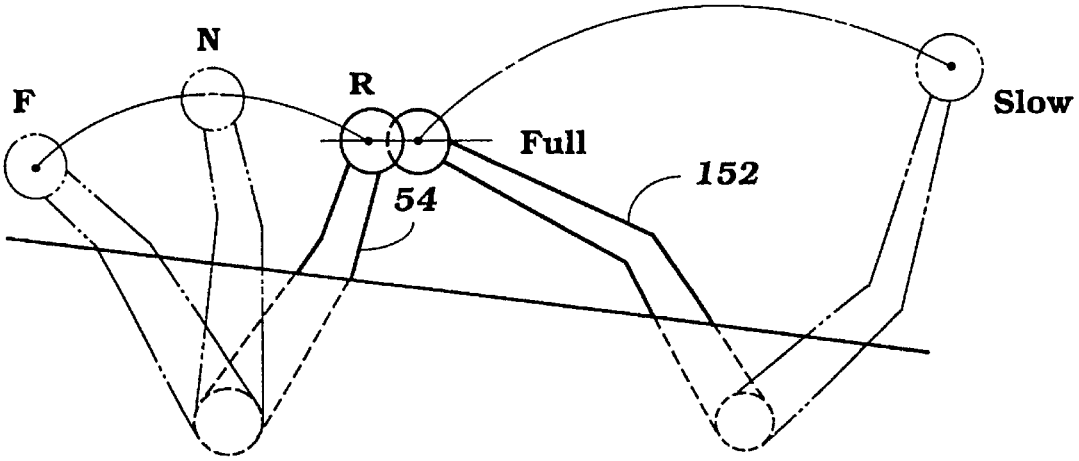
FIG. 19 is a side elevational view of this embodiment.

FIGS. 18 and 19 show another embodiment of the invention in which the construction of the throttle control levers 152 and transmission control levers 54 is the same and only the placement of these levers vary. For that reason, the same reference numerals have been employed to designate like parts. In this embodiment, it will be noted that the throttle control levers 152 and transmission levers 54 still move in parallel planes but they are slightly offset relative to each other. This permits the levers to be in overlapping relationship when in full reverse and at full throttle as shown clearly in these two figures while, at the same time, permitting the operator to operate the levers with the same hand and yet not have interference with his hand. In this and the preceding embodiment, the levers are constructed in such a way that their upper operator grip portions lie in the same vertical plane when in adjacent full reverse and full throttle conditions as clearly shown in FIGS. 17 and 19.

Figure 20:
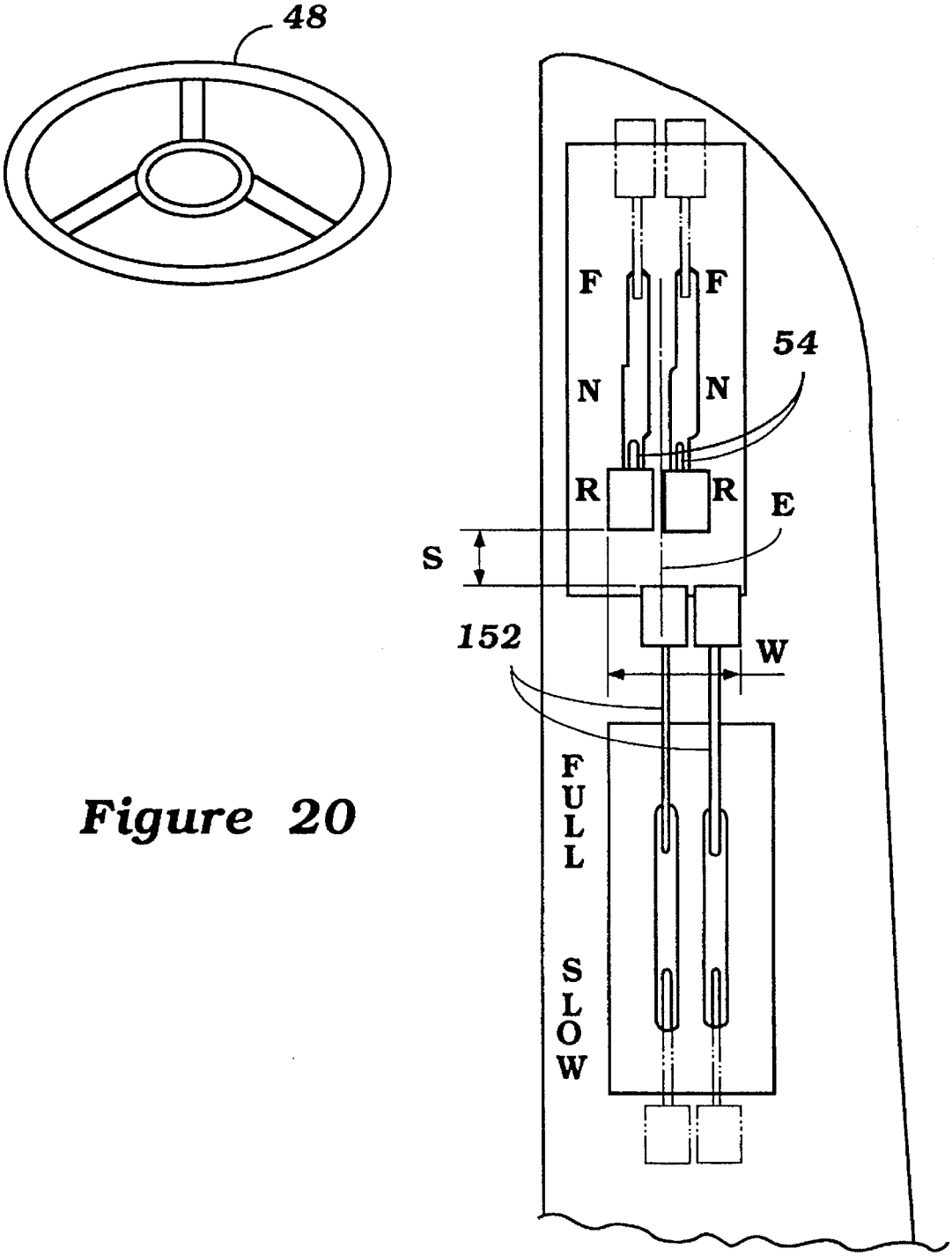
FIG. 20 is a top plan view, in part similar to FIGS. 15 and 18, and shows another embodiment.
Figure 21:
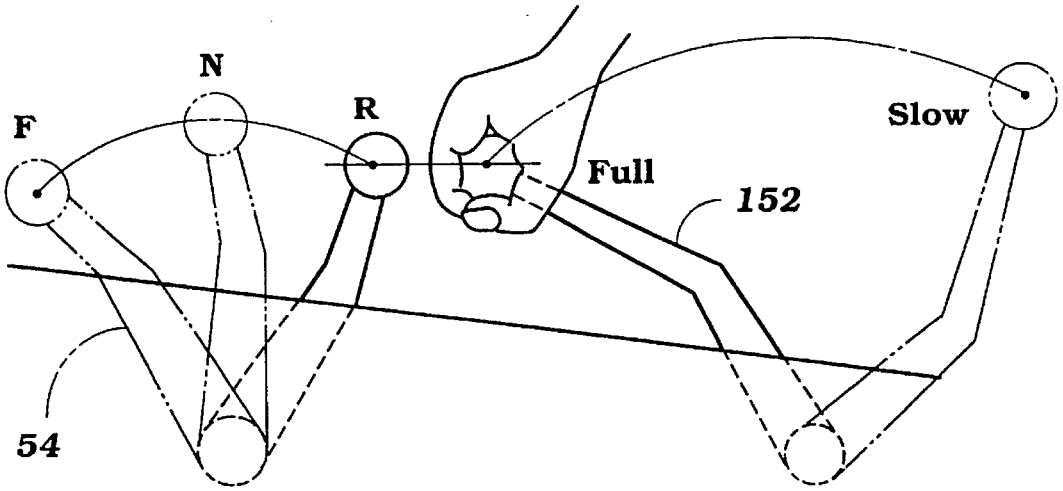
FIG. 21 is a side elevational view of this embodiment.

FIGS. 20 and 21 show another embodiment of the invention that has many characteristics the same as the embodiment of FIGS. 18 and 19. For that reason and since the throttle control levers and transmission control levers are the same as those previously described, the same reference numerals have been employed to designate them. In this embodiment, however, the transmission control levers are offset from the throttle control levers by a lesser amount and the levers are space for and aft by the distance S which is still adequate to afford access to the operator's hand as shown in FIG. 21. However, this relationship requires less width as indicated by the dimension W then the previously described embodiment. In this embodiment, the left hand throttle control lever 152 is positioned approximately midway between the two shift control levers 54 as shown by the center line E and FIG. 20.

Figure 22:
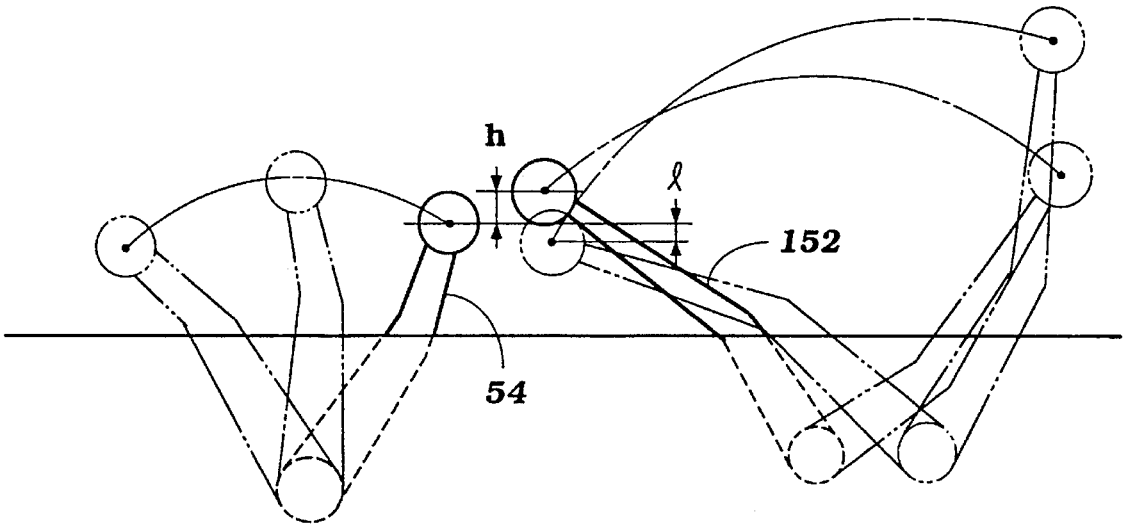
FIG. 22 is a side elevational view showing another embodiment of positioning arrangement for the transmission and throttle control levers.

All of the embodiments as thus far described, the shift control lever 54 and throttle control lever 152 have been configured so as to have the same vertical heights for their throttle grip portion when the throttle control lever 54 is in its reverse position and the throttle control lever 152 is in its full throttle position. There may be some instances where it is desirable to provide slightly different heights so that the operator can easily tell by feel which lever he is gripping and also to afford more clearance while permitting closer handling. FIG. 22 shows an arrangement wherein the throttle control lever 152 is either elevated by a raised height h relative to the shift control lever or lowered by a dimension 1 relative to it.

Figure 23:
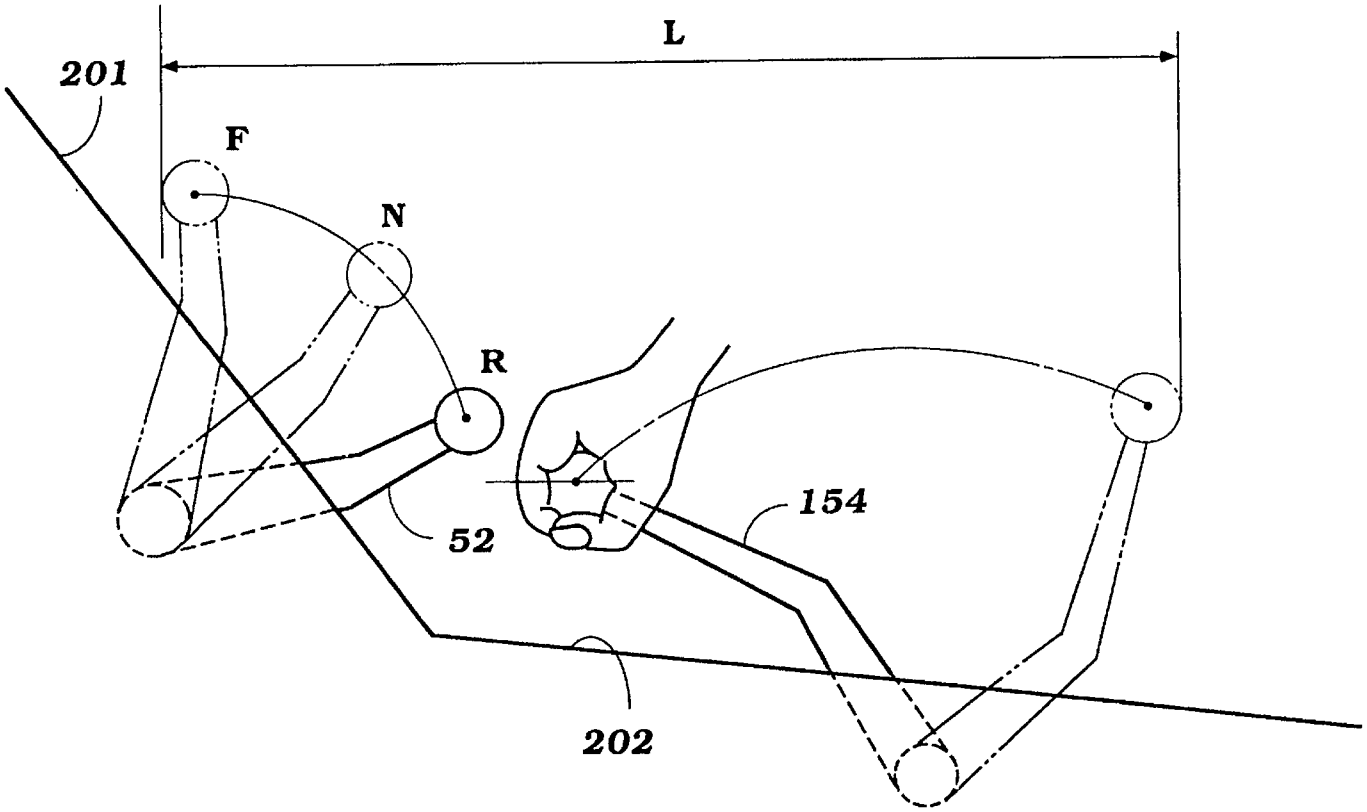
FIG. 23 is a side elevational view of a still further embodiment of transmission and throttle control arrangement.

FIG. 23 shows another in which the height variations may be changed while maintaining a more compact overall distance and permitting easier control for the operator. In this embodiment, the transmission control lever 52 is positioned on an inclined surface 201 of the watercraft while the throttle control lever 154 is positioned on a horizontal surface 202. As a result the length L between the extreme positions of the levers is substantially reduced.

Figure 24:
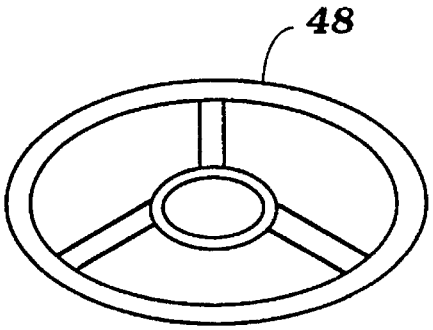
FIG. 24 is a top plan view, in part similar to FIGS. 18 and 20 and shows yet another embodiment of the invention.
Figure 24:
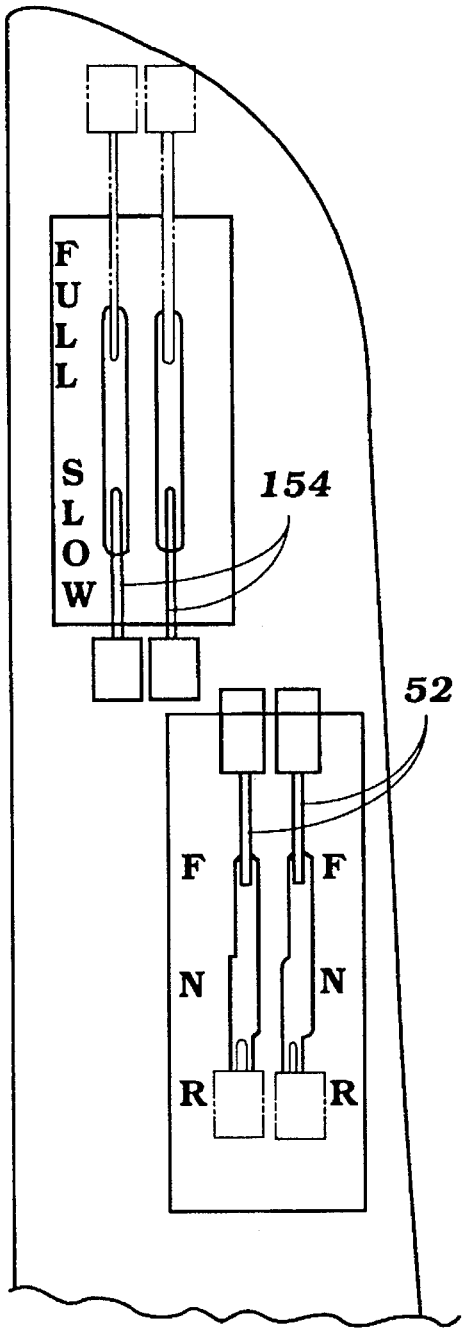
Figure 25:
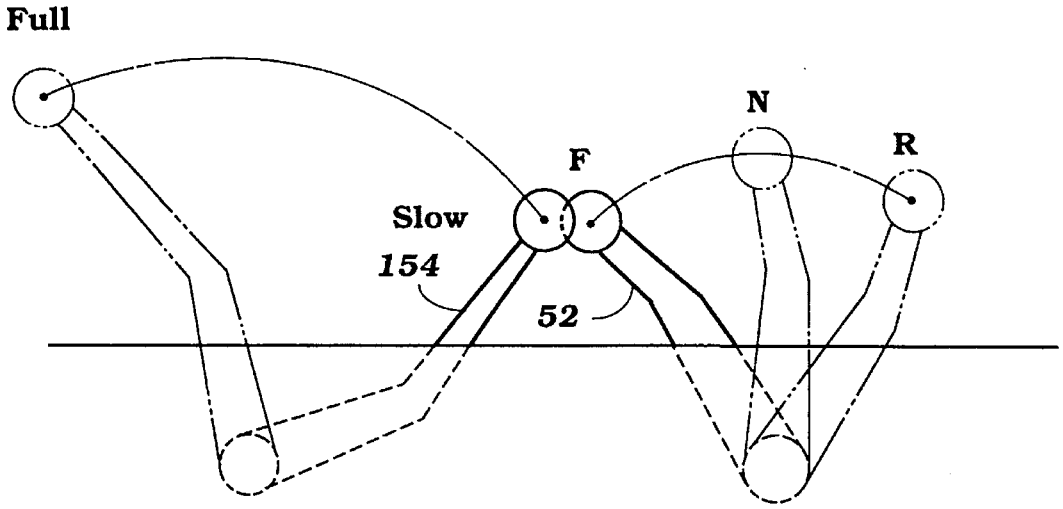
FIG. 25 is a side elevational view of this embodiment.

In all embodiments of the invention as previously described, the shift control levers 54 have been positioned in front of the throttle control levers 152. However, this condition can be reversed and FIGS. 24 and 25 show such a reversal. The reversed orientation can be utilized with any of the placements of the respective levers and height variations as previously described.

It shown be readily apparent from the foregoing description that the described embodiments of the invention provide an arrangement wherein a watercraft may be braked rapidly by shifting it into reverse or maneuvered rapidly by shifting one of its two propulsion units into reverse while still affording warning to a closely following watercraft. In addition, the shift mechanisms described have an interlock that prevents straight through motion from full forward to full reverse so as to avoid accidentally induced maneuvering. In addition various placements for the levers have been disclosed which permits ease of operation and maximum space utilization. Of course, the foregoing description is that of preferred embodiments of the invention and various changes and modifications may be made without departing from the spirit and scope of the invention, as defined by the appended claims.

We claim:

1. A marine vessel comprising a hull, means carried by said hull for propelling said hull and for braking the forward speed of said hull, operator controlled operating means for operating said means for braking the forward speed of said hull, an indicator means remotely positioned from said operating means and operated in response to operation of said operating means for providing an indication of when the speed of said hull is being braked, said indicator means being positioned to be seen from a following marine vessel.

2. A marine vessel comprising a hull as set forth in claim 1 wherein the indicator means is operative when the braking means is operated.

3. A marine vessel comprising a hull as set forth in claim 1 wherein the indicating means includes a switch responsive to the operation of the operating means for operating the braking means.

4. A marine vessel comprising a hull as set forth in claim 1 wherein the propulsion means and the means for braking the forward speed of the hull are a common unit.

5. A marine vessel comprising a hull as set forth in claim 4 wherein the means for braking the forward speed of the hull comprises means for shifting the propulsion means into a reverse drive mode.

6. A marine vessel comprising a hull as set forth in claim 5 further including shift control means for shifting the propulsion means between a forward mode and a reverse mode.

7. A marine vessel comprising a hull as set forth in claim 6 wherein the indicator means is responsive to the shifting of the propulsion means into the reverse mode.

8. A marine vessel comprising a hull as set forth in claim 6 wherein the indicator means is responsive to the operation of the shift control means.

9. A marine vessel comprising a hull as set forth in claim 5 wherein the propulsion means comprises a jet propulsion unit and the means for shifting the propulsion into a reverse mode comprises a reverse thrust bucket.

10. A marine vessel comprising a hull as set forth in claim 9 wherein the operating means comprises shift control means for shifting the reverse thrust bucket between a forward mode and a reverse mode.

11. A marine vessel comprising a hull as set forth in claim 6 further including interlock means operating on the shift control means for interrupting the shifting movement between a forward drive mode and a reverse drive mode.

12. A marine vessel comprising a hull as set forth in claim 11 wherein the interlock means comprises a shift gate having an interrupted path between the forward drive mode and the reverse drive mode.

13. A marine vessel comprising a hull as set forth in claim 11 wherein the propulsion means comprises a jet propulsion unit and the means for shifting the propulsion into a reverse mode comprises a reverse thrust bucket.

14. A marine vessel comprising a hull as set forth in claim 13 wherein the interlock means comprises a shift gate having an interrupted path between the forward drive mode and the reverse drive mode.

15. A marine vessel comprising a hull as set forth in claim 11 further including a throttle control lever for controlling the speed of the propulsion unit.

16. A marine vessel comprising a hull as set forth in claim 15 wherein the shift control means comprises a shift lever and the throttle control lever and the shift lever are disposed in fore and aft relationship with one behind the other and said levers move in generally parallel planes.

17. A marine vessel comprising a hull as set forth in claim 16 wherein the throttle control lever and the shift lever are offset laterally with respect to each other.

18. A marine vessel comprising a hull as set forth in claim 16 wherein the operating ends of the throttle control lever and the shift lever are adjacent to each other when the shift lever is in its reverse condition and the throttle control lever is at full throttle condition.

19. A marine vessel comprising a hull as set forth in claim 18 wherein the operating portions of the levers are at the same height when they are in their adjacent positions.

20. A marine vessel comprising a hull as set forth in claim 18 wherein the operating portions of the levers are at different heights when they are in their adjacent positions.

21. A marine vessel comprising a hull as set forth in claim 20 wherein the height differences are achieved by providing different length levers.

22. A marine vessel comprising a hull as set forth in claim 20 wherein the height differences are achieved by mounting the levers at different vertical heights.

23. A marine vessel comprising a hull as set forth in claim 5 further including a throttle control lever for controlling the speed of the propulsion unit.

24. A marine vessel comprising a hull as set forth in claim 13 wherein there are a pair of propulsion units each with its own respective control lever and shift control.

25. A marine vessel comprising a hull as set forth in claim 24 wherein the shift control means comprises a shift lever and the throttle control lever and the shift lever are disposed in fore and aft relationship with one behind the other and said levers move in generally parallel planes.

26. A marine vessel comprising a hull as set forth in claim 25 wherein the throttle control lever and the shift lever are offset laterally with respect to each other.

27. A marine vessel comprising a hull as set forth in claim 25 wherein the operating ends of the throttle control lever and the shift lever are adjacent to each other when the shift lever is in its reverse condition and the throttle control lever is at full throttle condition.

28. A marine vessel comprising a hull as set forth in claim 27 wherein the operating portions of the levers are at the same height when they are in their adjacent positions.

29. A marine vessel comprising a hull as set forth in claim 27 wherein the operating portions of the levers are at different heights when they are in their adjacent positions.

30. A marine vessel comprising a hull as set forth in claim 29 wherein the height differences are achieved by providing different length levers.

31. A marine vessel comprising a hull as set forth in claim 30 wherein the height differences are achieved by mounting the levers at different vertical heights.

* * * * *